United States Patent [19]

Williams et al.

[11] 4,244,292

[45] Jan. 13, 1981

[54] INKER APPARATUS

[75] Inventors: Robert Williams, Randolph; Albin Rohr, Rockaway, both of N.J.

[73] Assignee: Sun Chemical Corporation, New York, N.Y.

[21] Appl. No.: 85,480

[22] Filed: Oct. 17, 1979

[51] Int. Cl.[3] ..... B41F 31/06; B41F 31/04; B41F 31/34; B41H 27/06

[52] U.S. Cl. ..... 101/350; 101/DIG. 14; 101/352; 101/364

[58] Field of Search ..... 101/350, 366, 363, 364, 101/351, 352, 206, 207, 208, 209, 210, 38 R, 38 A, 365, 148, DIG. 14; 118/258, 259, 261

[56] References Cited

U.S. PATENT DOCUMENTS

| | | | |
|---|---|---|---|
| 1,580,829 | 4/1976 | Lengel | 101/350 |
| 2,986,088 | 5/1961 | Chase et al. | 101/350 |
| 3,037,451 | 6/1962 | Davis | 101/350 |
| 3,585,932 | 6/1971 | Granger | 101/350 |

*Primary Examiner*—J. Reed Fisher
*Attorney, Agent, or Firm*—Cynthia Berlow

[57] ABSTRACT

Inker apparatus constructed primarily for the application of high viscosity paste-type ink includes an anilox fountain roll which partially defines an ink trough. The latter is also partially defined by a scraper blade disposed downstream of a wiper blade which forces ink into the cells of the anilox roll. The free edge of the scraper blade is disposed adjacent the cylindrical surface of the anilox roll to meter the quantity of ink which is removed from the trough by the anilox roll. Two distributor rolls are used to transfer ink from the anilox roll to a plate cylinder. One of the distributor rolls engages the image plate on the plate cylinder and the other distributor roll engages the anilox roll. The latter distributor roll is oscillated axially so that the cellular pattern of the anilox roll will not be transferred to the first mentioned distributor roll.

8 Claims, 3 Drawing Figures

INKER APPARATUS

This invention relates to inker apparatus in general and more particularly relates to apparatus of this type constructed primarily for use with paste-type ink.

U.S. Pat. No. 3,645,201 issued Feb. 29, 1979, to J. M. Jackson for a Multi-Color Printing Machine for Cylindrical and Frusto-Conical Objects, discloses apparatus in which objects to be decorated are carried by a turret which is angularly stepped so that each of these objects is carried to a plurality of decorating stations and drying stations, with a drying station being disposed immediately downstream of each of the decorating stations. At each decorating station a decoration is applied to the object and this decoration is air dried at the next drying station. In order to obtain high speed operation, the object is at each decorating and drying station for only a short interval, yet satisfactory air drying is obtained because a high solvent or low viscosity ink is used. However, this type of ink requires extra preparations which are not required when utilizing high viscosity paste-type ink, typically a type which is cured by ultraviolet radiation.

That is, since a low viscosity, high solvent flexo ink dries so rapidly, it cannot be permitted to remain overnight in the decorating apparatus. Further, one start-up, results are not reasonably predictable insofar as drying time and adhesive properties. In contrast, high viscosity paste-type ink may remain in the decorating apparatus overnight or even for days without adverse results, and on start-up results are readily predictable.

Thus, the instant invention provides novel inking apparatus for use in a process decorator of the type described generally in the aforesaid U.S. Pat. No. 3,645,201 when paste-type inks are utilized.

Inking apparatus constructed in accordance with the instant invention utilizes an inilox fountain roll together with a scaper-type blade for metering and a wiper-type blade to force ink into the cells of the anilox roll and thereby purge these cells of air. The arrangement of the anilox roll, scraper blade and wiper blade is such that excess ink removed from the anilox roll by the scaper blade is forced to circulate within an ink pool, upwardly through apertures in the wiper blade and into the tapered space bounded by the wiper blade and anilox roll.

In order to improve the quality of printing when large areas of uniform coloring are to be printed, a rubber covered distributor roll is utilized to transfer ink from the anilox roll to a steel distributor roll in contact with the printing plate. The rubber covered distributor roll is oscillated axially to eliminate transferring an image of the cell pattern of the anilox roll to the printing plate.

Accordingly, a primary object of the instant invention is to provide novel inker apparatus utilized especially for the application of paste-type ink.

Another object is to provide inker apparatus of this type having improved means for recirculating excess ink removed from a fountain roll.

A further object is to provide inker apparatus of this type having improved means for obtaining large areas of uniform color when utilizing an anilox-type roll.

These objects as well as other objects of this invention shall become readily apparent after reading the following description of the accompanying drawings in which.

Figure 1:
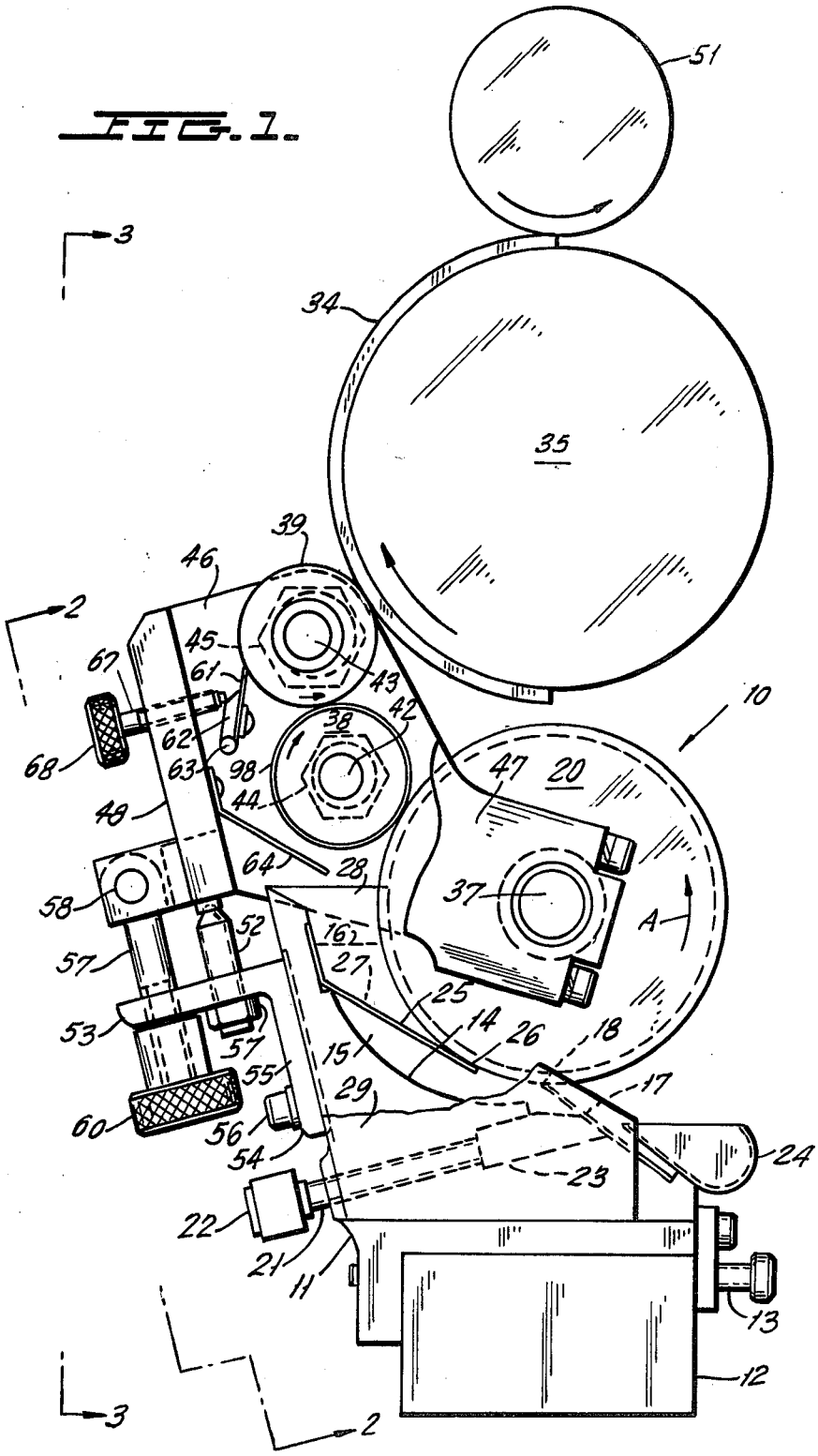
FIG. 1 is a side elevation, partially sectioned, of inker apparatus constructed in accordance with teachings of the instant invention.
Figure 2:
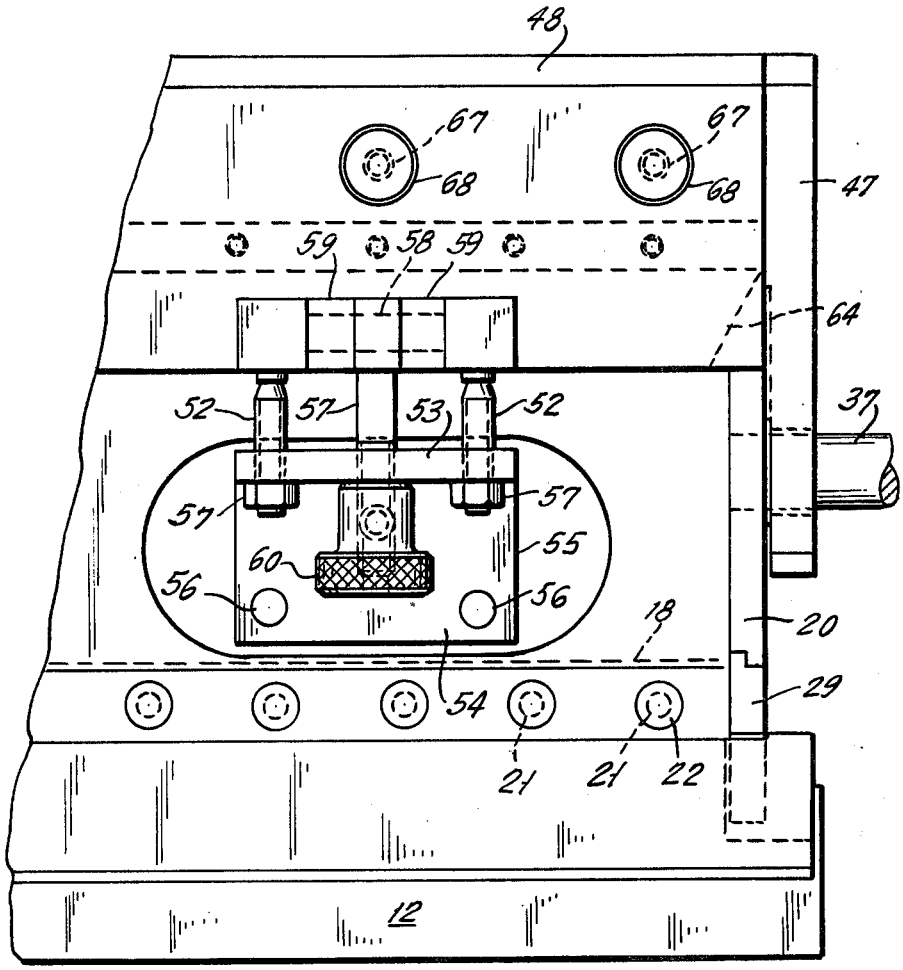
FIG. 2 is a partial elevation looking in the direction of arrows 2—2 in FIG. 1.

Now referring to the drawings which show inker apparatus 10 constructed in accordance with teachings of the instant invention. Apparatus 10 includes base 11 which is removably mountable on frame 12 of a process decorator (not shown) and maintained in position by clamping screw 13. Arcuate surface 14 of base 11 partially defines trough 15 which holds a pool of paste-type ink extending upward to the level indicated by dashed line 16. Trough 15 is also defined by a portion of anilox fountain roll 20 and scraper-type blade 17 whose free or metering edge 18 is adjacent to the periphery of anilox roll 20.

Blade 17 is an elongated member constructed of spring steel and has the longitudinal portion thereof opposite metering edge 18 fixedly secured to base 11. A plurality of screws 21 threadably mounted to base 11 are each provided with a knurled head 22 disposed outside of trough 15 for hand engagement. Slide block 23 is interposed between scraper 17 and the end of screw 21 opposite head 22 so that as screw 21 is rotated, force is transmitted through block 23 to adjust the position of metering edge 18, thereby controlling the amount of ink removed from trough 15 by anilox roll 20. Small trough 24 secured to base 11 on the downstream side of blade 17 is positioned to catch drippings that may work their way along the downstream side of blade 17.

Figure 3:
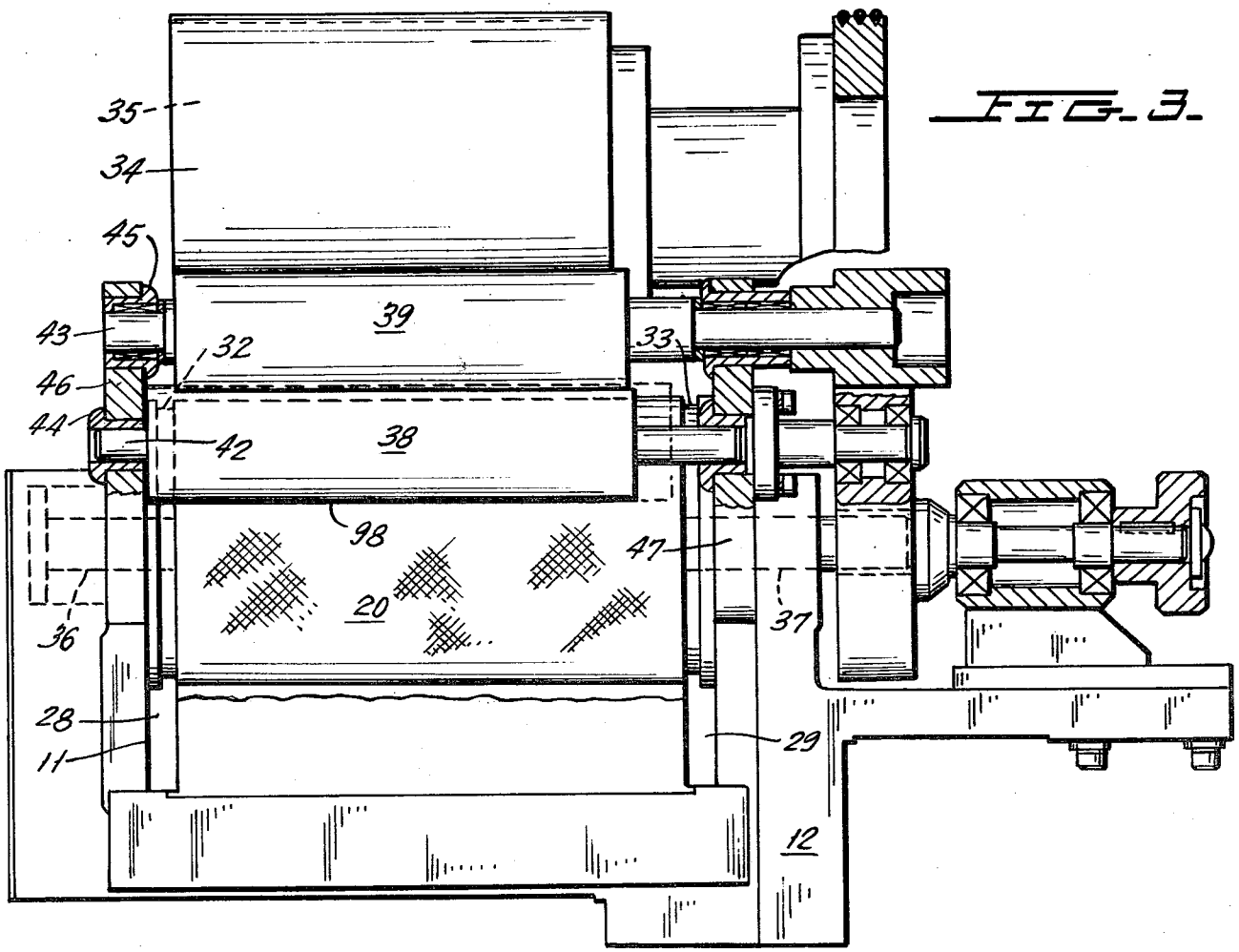
FIG. 3 is an elevation looking in the direction of arrows 3—3 of FIG. 1.

Elongated steel wiper blade 25 is disposed within trough 15 and is fixedly secured along its longitudinal upper edge to base 11. Working edge 26 of wiper blade 25 is self-biased into engagement with the periphery of anilox roll 20 along a line upstream of metering edge 18. For a reason to be hereinafter explained, wiper blade 25 is provided with a plurality of longitudinally spaced apertures 27 aligned in a row intermediate working edge 26 and arcuate surface 14 of base 11. End walls 28, 29 of trough 15 are secured to base 11 and stepped at their free arcuate upper edges. The latter extend into respective annular grooves 32, 33 (FIG. 3) in anilox roll 20 near the ends thereof to form labyrinth-type end seals.

Anilox roll 20 rotates in the direction of arrow A about a central axis defined by aligned axial extensions 36, 37 at opposite ends of roll 20. Extensions 36, 37 are seated in bearings mounted on frame 12. As anilox roll 20 rotates the peripheral cells thereof are filled with ink through the wedging action of wiper blade 25. This wedging action forces ink into the cells of roll 20 to purge these cells of air. As the ink-filled cells of roll 20 move downstream of working edge 26, excess ink is removed by scraper-type blade 17 and returned to the lower portion of trough 15 disposed below wiper blade 25. This portion of trough 15 is filled with ink so that the excess ink removed by blades 17 forces ink upward through apertures 27 into the region of trough 15 located above wiper blade 25 where this ink is forced into the cells of anilox roll 20.

Ink carried by anilox roll 20 downstream of metering edge 18 is transmitted to printing plate 34 on plate cylinder 35 by distributor rolls 38, 39 which are mounted for rotation about axes which coincide with their respective axial extensions 42, 43. The ends of extensions 42, 43 are mounted by eccentric-type adjusting means to the respective spaced arms 46, 47 which extend parallel to one another and are secured to transverse member 48. The ends of arms 46, 47 remote from member 48 are pivotally mounted on axial extensions 36, 37 of anilox roll 20. Similarly, adjustable eccentrics 45 mount opposite ends of axis 43 to arms 46, 47. The outer surface of distributor roll 38 is provided by rubber-like jacket 98 which is in engagement with anilox roll 20 and the other distributor roll 39. The outer surface of the latter is constructed of smooth steel and engages printing plate 34. Thus, ink carried upstream from metering edge 18 by anilox roll 20 transfers to distributor roll 38 and then to distributor roll 39, finally being applied to printing plate 34 which engages the periphery of container 51 to apply decorations to the exterior cylindrical surface thereof.

The assembly of distributor rolls 38, 39 and their supporting elements 46, 47, 48 are pivotally mounted for adjustment about anilox roll extensions 37 as a center. This adjustment is effected by a pair of adjusting screws 52 which extend through threaded apertures in the generally horizontal leg 53 of L-shaped bracket 55 whose generally vertical leg 54 is secured to the rear of base 11 by screws 56. The upper ends of adjusting screws 52 bear against inserts projecting from the lower edge of transverse element 48. Lock nuts 57 are mounted at the lower ends of each adjusting screw 52. Clamping screw 57 holds element 48 seated on adjusting screws 52. The upper end of screw 57 is pivotally mounted on a transverse pin 58 which extends between projections 59, 59 mounted rear of element 48. The threaded lower end of screw 57 extends through a notch in horizontal leg 53. Knurled nut 60 is mounted to the threaded portion of clamping screw 57 which extends below horizontal leg 53.

The assembly which includes distributor rolls 38, 39 also includes scraper-type scavenger blade 61 mounted in holder 62 and extending between arms 46, 47, being pivotally mounted thereto on axial extensions 63. The free upper edge of scraper blade 61 rides against the periphery of steel distributor roll 39 to remove ink which has not been transferred from distributor roll 39 to printing plate 34. The ink that is removed falls downward and is directed by deflector 64 into the upper end of trough 15. The upper edge of deflector 64 is secured to the forward surface of element 48. Three screws 67, each having an enlarged knurled head 68, extend through threaded apertures in element 48 with the forward ends of screws 67 bearing against blade holder 62 to adjust the pressure of blade 61 against the periphery of distributor roll 39.

Each of the rolls 20, 35, 38, 39 and container 51 rotates in the direction indicated by the respective arrows thereon. As the rubber-covered distributor roll 38 rotates, it also reciprocates axially between the solid line and phantom positions shown in FIG. 3, so that ink deposited on distributor roll 39 will not contain an image of the cell pattern of anilox roll 20. A typical means for causing axial reciprocation of distributor roll 38 includes forming axis 48 as a rod which is locked against rotation and is provided with a stationary cam groove (not shown). Internally of distributor roll 38 there is a radial pin (not shown) which rides in the aforesaid cam group to cooperate therewith and axially reciprocate distributor roll 38 as the latter rotates.

The terms scraper blade and wiper blade as used herein distinguish between the manner in which these blades are positioned with respect to an inking system fountain roller. More particularly, there is substantially less than a 90° angle between a scraper blade and a tangent to the fountain roll extending downstream from the free or metering edge of the scraper blade. This is sometimes referred to as an arrangement in which the "blade is disposed oppositely to the direction of rotation of the fountain roller" (see U.S. Pat. No. 1,825,999 issued Oct. 6, 1931, to H. Fankboner for an Inking Mechanism). For a wiper blade there is substantially less than a 90° angle between the wiper blade and a tangent to the inking system roll extending upstream from the free or working edge of the wiper blade.

While the instant invention has been described in connection with decorating cylindrical and conical surfaces, it should now be apparent to those skilled in the art that this invention is also applicable to printing and decorating other forms, such as webs and sheets, whether of metal, plastic, paper, or other materials.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. Inker apparatus constructed primarily for the application of paste-type ink; said inker apparatus including first means defining an ink containing trough partially bounded by a rotationally mounted fountain roll and a scraper blade; said scraper blade including a metering edge adjacent the outer cylindrical surface of said fountain roll and extending parallel to the rotational axis of the latter; said outer cylindrical surface having a cellular pattern formed therein; a wiper blade for forcing ink into the cells of said outer cylindrical surface; said wiper blade including a forward working edge inside said trough extending parallel to said rotational axis and disposed adjacent said outer cylindrical surface; said working edge being above said metering edge and below the ink level in said trough; and ink passage means behind said working edge disposed to permit ink removed from said fountain roll to circulate in said trough and be reapplied to said fountain roll at a position above said working edge.

2. Inker apparatus as set forth in claim 1 also including a plate cylinder rotationally mounted on an axis parallel to said rotational axis; first and second distributor rolls rotationally mounted on axes parallel to said rotational axis; said first distributor roll being operatively positioned to transfer ink from said fountain roll to said second distributor roll; said second distributor roll being operatively positioned to transfer ink from said first distributor roll to said plate cylinder; said first distributor roll having a rubber-like outer surface; and means for oscillating the latter parallel to the cylindrical axis and relative to the outer cylindrical surface of said fountain roll.

3. Inker apparatus as set forth in claim 2 also including scraper blade means operatively positioned to remove ink from said second distributor roll which fails to transfer from the latter to said plate cylinder; and guide means to direct ink, removed by the scraper blade means, to said trough at a location above the working edge of said wiper blade.

4. Inker apparatus as set forth in claim 1 in which a plurality of apertures in said wiper blade constitutes said ink passage means.

5. Inker apparatus as set forth in claim 2 in which the first and second distributor rolls are portions of an assembly which is pivotally adjustable relative to said trough about an axis coinciding with the rotational axis of the fountain roll.

6. Inker apparatus as set forth in claim 5 in which the assembly includes first and second parallel arms supporting opposite ends of said first and second distributor rolls, and eccentric type adjusting means mounting the distributor rolls to said arms for paralleling the rotational axes of the distributor rolls to the rotational axis of the fountain roll.

7. Inker apparatus as set forth in claim 5 also including scavenger blade means operatively positioned to remove ink from said second distributor roll which fails to transfer from the latter to said plate cylinder; and guide means to direct ink, removed by the scavenger blade means, to said trough at a location above the working edge of said wiper blade, both said scavenger blade means and said guide means being portions of said assembly.

8. Inker apparatus as set forth in claim 7 in which a plurality of apertures in said wiper blade constitutes said ink passage means.

* * * * *